US009044631B2

(12) United States Patent
Gerner et al.

(10) Patent No.: US 9,044,631 B2
(45) Date of Patent: Jun. 2, 2015

(54) METHOD AND APPARATUS FOR CLIMBING

(71) Applicants: Mark H. Gerner, Burke, VA (US); Michael Decavalcante, Camp Hill, PA (US)

(72) Inventors: Mark H. Gerner, Burke, VA (US); Michael Decavalcante, Camp Hill, PA (US)

( * ) Notice: Subject to any disclaimer, the term of this patent is extended or adjusted under 35 U.S.C. 154(b) by 0 days.

(21) Appl. No.: 13/926,570

(22) Filed: Jun. 25, 2013

(65) Prior Publication Data

US 2013/0327592 A1 Dec. 12, 2013

Related U.S. Application Data

(63) Continuation of application No. 12/687,476, filed on Jan. 14, 2010, now abandoned.

(60) Provisional application No. 61/145,286, filed on Jan. 16, 2009.

(51) Int. Cl.

| | |
|---|---|
| ***A63B 29/02*** | (2006.01) |
| ***A63B 29/00*** | (2006.01) |
| ***A62B 35/00*** | (2006.01) |

(52) U.S. Cl.

CPC ..... *A63B 29/00* (2013.01); *A62B 35/0081* (2013.01); *A63B 29/02* (2013.01)

(58) Field of Classification Search

CPC ..... A62B 1/04; A62B 1/06; A62B 35/04; A62B 35/0037; A62B 35/0081; A62B 1/14; A63B 29/00; A63B 29/02; A47L 3/00; A47L 3/04

USPC ..... 182/3, 4, 5, 189, 190, 191, 192, 193

See application file for complete search history.

(56) References Cited

U.S. PATENT DOCUMENTS

| | | | | | |
|---|---|---|---|---|---|
| 983,335 | A * | 2/1911 | Westad | 182/135 |
| 1,021,986 | A * | 4/1912 | Johnson | 24/136 R |
| 2,561,514 | A * | 7/1951 | Houseman | 188/65.2 |
| 3,179,994 | A * | 4/1965 | Meyer et al. | 24/134 R |
| 3,470,982 | A * | 10/1969 | Warden, Jr. | 182/192 |
| 3,814,210 | A * | 6/1974 | Hoffman | 182/6 |
| 3,869,021 | A * | 3/1975 | Sutherland et al. | 182/3 |
| 3,938,620 | A * | 2/1976 | Nothiger | 182/135 |
| 4,034,828 | A * | 7/1977 | Rose et al. | 182/5 |
| 4,276,958 | A * | 7/1981 | Skaalen | 182/135 |
| 4,301,891 | A * | 11/1981 | Harbian | 182/135 |
| 4,494,629 | A * | 1/1985 | Raeburn | 188/65.5 |
| 4,542,884 | A * | 9/1985 | Dodge, Jr. | 254/391 |
| 4,598,793 | A * | 7/1986 | Lew et al. | 182/42 |
| 4,667,772 | A * | 5/1987 | Kammerer | 182/6 |
| 4,679,654 | A * | 7/1987 | Lu | 182/5 |
| 4,921,069 | A * | 5/1990 | Boyles | 182/135 |
| 4,928,791 | A * | 5/1990 | Hong | 182/135 |
| 5,029,669 | A * | 7/1991 | Lew et al. | 182/42 |
| 5,234,075 | A * | 8/1993 | Lowden | 182/135 |
| 5,638,919 | A * | 6/1997 | Pejout | 182/192 |
| 5,924,522 | A * | 7/1999 | Ostrobrod | 182/191 |
| 6,712,181 | B2 * | 3/2004 | Nichols | 182/192 |
| 6,793,046 | B2 * | 9/2004 | Petzl et al. | 188/188 |
| 6,899,203 | B1 * | 5/2005 | Golden et al. | 188/65.4 |
| 2012/0118666 | A1 * | 5/2012 | Raoul Bingham | 182/5 |

* cited by examiner

*Primary Examiner* — Colleen M Chavchavadze

(74) *Attorney, Agent, or Firm* — Dunlap Codding, P.C.

(57) ABSTRACT

The present invention is an apparatus and method for climbing, and more particularly but not by way of limitation an apparatus and method for ascending and descending a rope, for use by individuals with disabilities. The method and apparatus generally includes a combination of devices and a combination of steps which enables an individual climber to ascend and descend a rope while benefiting from the mechanical advantage of a rope assembly.

3 Claims, 4 Drawing Sheets

METHOD AND APPARATUS FOR CLIMBING

INCORPORATION BY REFERENCE OF RELATED APPLICATIONS

This present patent application hereby incorporates by reference the patent application identified by U.S. Ser. No. 12/687,476, which was filed on Jan. 14, 2010, which claims the benefit of U.S. Provisional Application No. 61/145,286, filed Jan. 16, 2009.

STATEMENT REGARDING FEDERALLY SPONSORED RESEARCH OR DEVELOPMENT

Not applicable.

FIELD OF INVENTION

The present invention relates generally to a method and apparatus for climbing, and more particularly but not by way of limitation to a method and apparatus for ascending and descending a rope, for use by individuals with disabilities.

BACKGROUND

Rock climbing is an excellent form of exercise. Rock climbing tests and conditions a climber's strength, endurance, agility, balance and mental control. Thus, rock climbing is an ideal activity for individuals in need of physical and mental exercise, including disabled individuals and individuals in need of physical therapy. Unfortunately, many of these individuals have been unable to participate in rock climbing because of a lack of specialized techniques and specialized equipment for individuals with disabilities and individuals undergoing physical therapy.

Therefore, a need exists for a system which permits individuals with disabilities and individuals in need of physical therapy to rock climb in a manner similar to that experienced by non-disabled experienced rock climbers. It is to such a system that the present invention is directed.

DETAILED DESCRIPTION OF THE DRAWINGS

Figure 1:
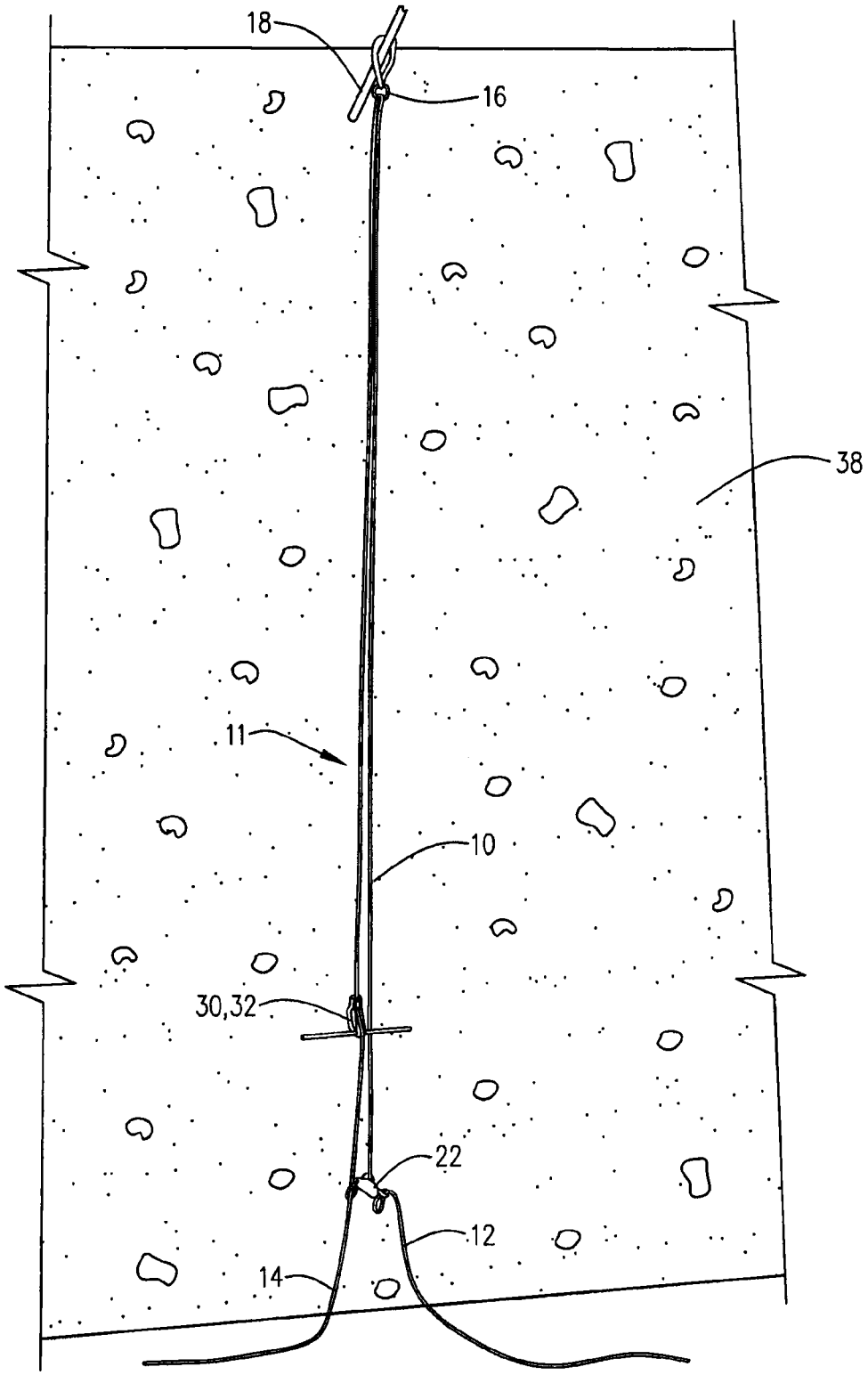
FIG. 1 is a drawing of a rope assembly, for permitting an individual to ascend and descend a rope.

Before explaining at least one embodiment of the invention in detail, it is to be understood that the invention is not limited in its application to the details of construction and the arrangement of the components or steps or methodologies set forth in the following description or illustrated in the drawings. The invention is capable of other embodiments or of being practiced or carried out in various ways. Also, it is to be understood that the phraseology and terminology employed herein is for the purpose of description and should not be regarded as limiting.

The rope assembly generally includes a combination of devices and a combination of steps which enables an individual climber to ascend and descend a rope while benefiting from the mechanical advantage of the rope assembly. The rope assembly includes a pulley connected to a support structure, the support structure being positioned a distance above a ground surface. A rope threadingly connected to the pulley, the rope having a first end and a second end. A waist harness adapted to be secured about the waist of an individual during climbing, the waist harness connected to the first end of the rope. A chest harness adapted to be secured about the chest of an individual during climbing, the chest harness connected to the second end of the rope and connected to the waist harness. A handgrip connected to the rope, the handgrip connected a distance above an individual climber's head such that an individual climber can reach the hand grip. Once the climber is secured into the chest and waist harness, the climber can apply force to the handgrip such that an individual climber can ascend and descend the rope. As climbing activity begins, a stopper knot is tied below the belay device for additional safety.

Referring now to FIGS. 1-4, shown therein are drawings of a rope assembly 11 designed in accordance with the present invention. As shown in FIG. 1 the rope assembly 11 includes a climbing rope 10 having a first end 12 and a second end 14. Any form of climbing rope may be used, including but not limited to a 50 m semi static climbing rope. The climbing rope 10 is extended through a pulley 16 which is designed to be suspended from an overhead support 18. Any type of pulley sufficient to enable a climber to ascend and descend the rope 10 may be used and any type of overhead support 18 may be used as long as the pulley 16 and overhead support 18 are sufficient to safely support the weight of the climber at height. For example, the pulley 16 may be connected to a support beam or I-beam of a building or a similar type of structure.

Figure 2:
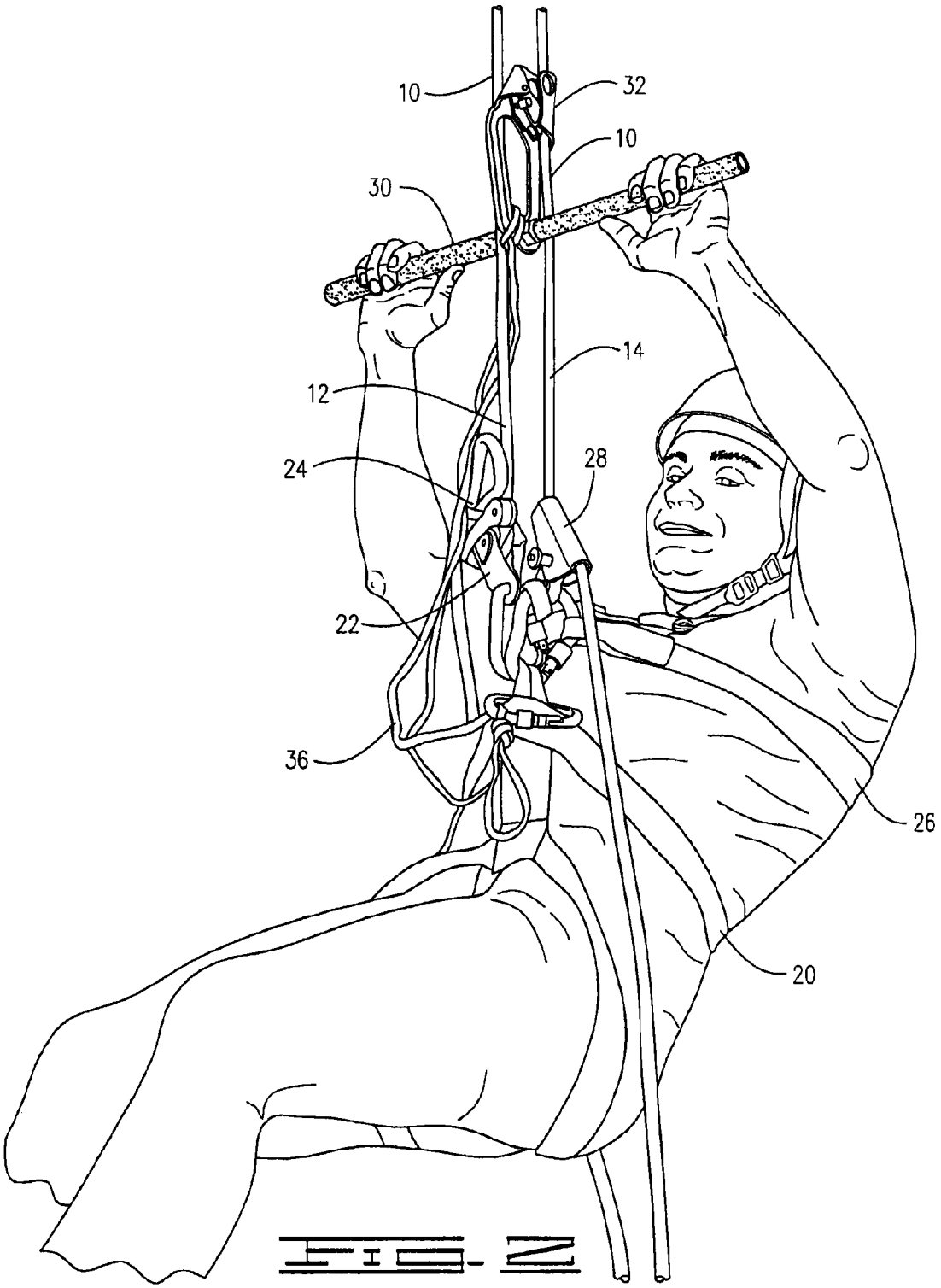
FIG. 2 is a drawing of an individual climbing the rope assembly of FIG. 1.

Referring now to FIG. 2, the first end 12 of the rope 10 is connected to the climber's waist harness 20 using a belay device 22, with a back-up or "stopper" knot 24 for additional safety. Any type of waist harness may be used, including but not limited to a, certified UIAA ("Union Internationale des Association d'Alpinsme") waist harness or a length of nylon webbing, tied into continuous loops with two overhand knots that are placed to tie together at the climbers' middle chest. Preferably, the nylon runner of the waist harness 20 should be double stitched.

The second end 14 of the rope 10 is connected to a climbers' chest harness 26 with an industry standard ascender 28 suitable for the body type and weight of the climber. Any type of chest harness may be used, including but not limited to adjustable chest harnesses approved by the UIAA.

While, the rope 10 is shown connected to the climbers' chest harness 26 with an ascender 28, it should be noted that the rope 10 can be connected to the climber's chest harness 26 by any mechanism which would permit the climber to safely ascend the rope 10 as described herein. For example the rope 10 may be connected to the climbers' chest harness 26 with a basic ascender, tiblock ascender, croll ascender, or chest ascender.

Figure 3:
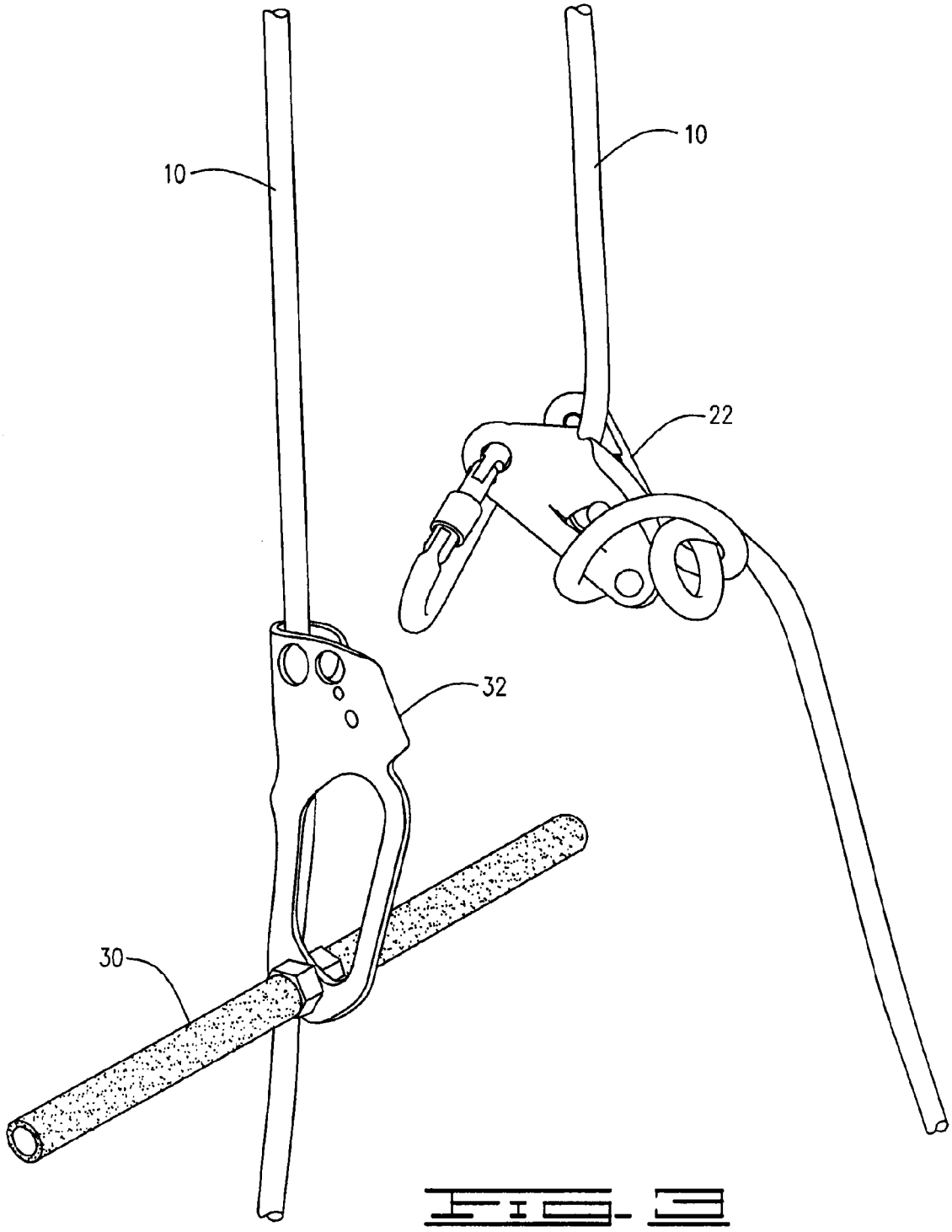
FIG. 3 is a drawing of the handle-bar mounted grip and belay device of the rope assembly of FIG. 1.

In addition, a handle-bar mounted grip 30 is connected to the rope 10 by a second industry standard ascender 32 (substantially as shown in FIG. 3). However, it should be noted that the rope 10 can be connected to the handle-bar mounted grip 30 by any mechanism which would permit the climber to safely ascend and descend the rope 10 as described herein. For example the rope 10 may be connected to the handle-bar mounted grip 30 with a basic ascender, tib lock ascender, croll ascender, or chest ascender.

As shown in FIG. 3, the handle-bar mounted grip 30 is a steel cylinder, ¾ inch in diameter that fits inside the hole of an ascender, and is anchored with two bolts. This steel bar is then padded and taped, and secured with two locking nuts to the ascender, creating a handle bar. However, it should be understood that any type of handlebar-mounted grip may be used which would enable a climber to safely ascend and descend the rope as described herein.

The ascender 32 is also connected to a back-up cord 34 which can be tied to the chest harness 26 of the climber (substantially as shown in FIG. 2). The handlebar mounted grip 30 is locked to the rope 10, at a safe height above the climber's eyes. A tie 36 (substantially as shown in FIG. 2) is also connected to the ascender 32 and clipped to the climber's chest harness 26. This safety precaution is desirable if a situation develops where the climber is in need of assistance, and unlocks the ascender 32 from the rope 10, and then drops the ascender 32. Should this happen at height, the tie 36 will prevent loss of the ascender 32.

The handle-bar mounted grip 30 permits an individual climber to execute a pull-up style rope climbing action which enables the climber to ascend and descend the rope 10. As the climber pulls down on the handle-bar mounted grip 30, tension is created above the handlebar mounted grip 30, while slack is achieved below the handle-bar mounted grip 30. This action permits the climber to gain height by decreasing the size of the loop between the pulley 16 and the climber's chest harness 26 and waist harness 20. The rope assembly 11 can also be placed adjacent to a climbing wall 38 (substantially as shown in FIG. 1), such that an individual climber can use both the climbing wall 38 and the rope assembly 11 during climbing.

Figure 4:
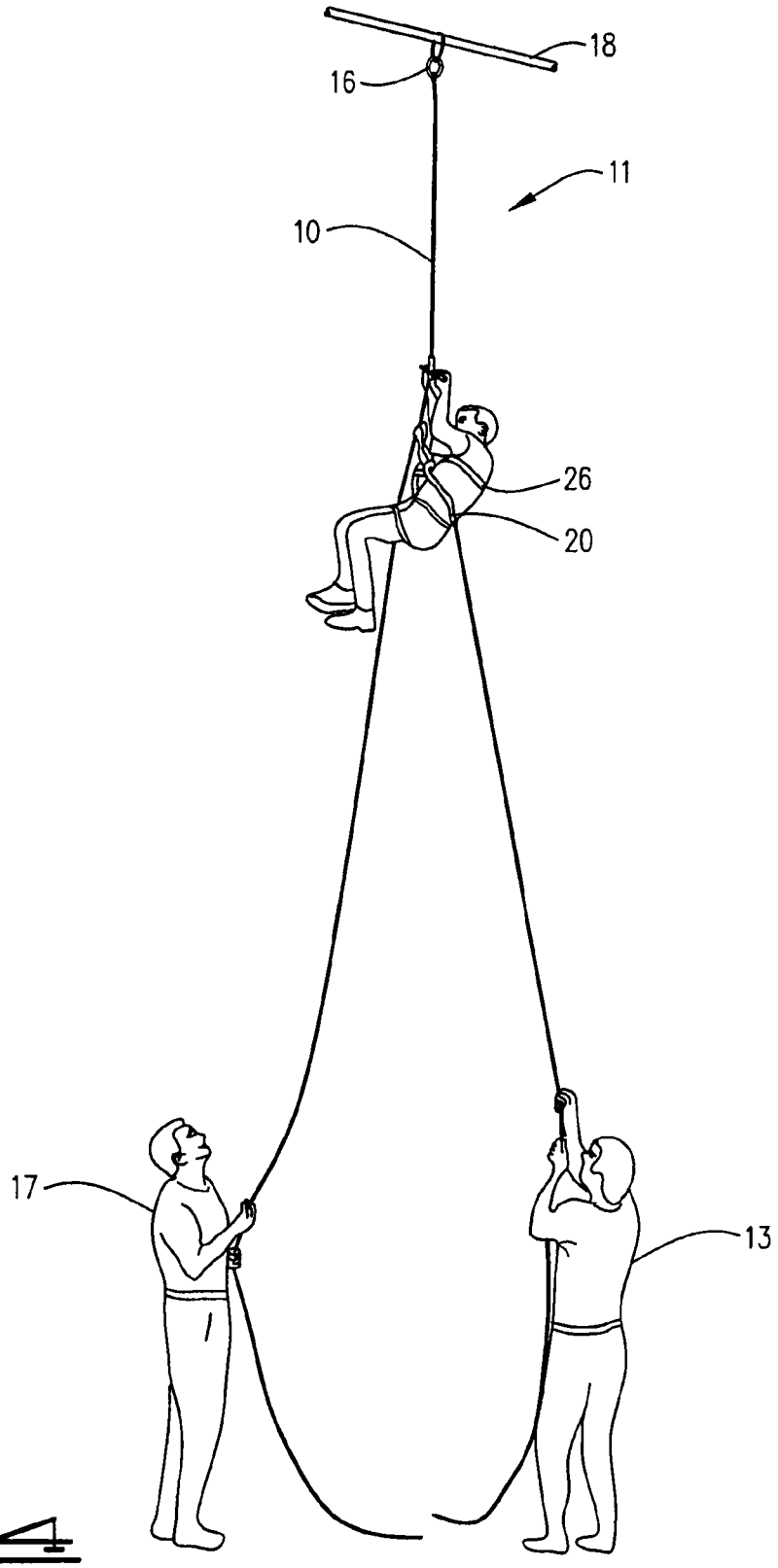
FIG. 4 is a drawing of an individual climbing the rope assembly of FIG. 1 with the help of an ascent coach and a descent coach.

Referring now to FIG. 4, shown therein is a photograph of an individual climbing the rope assembly 11 with the help of an ascent instructor/coach 13 and a descent instructor/coach 17. To ascend and descend the rope assembly 11, the climber relies on the rope 10. The rope 10 threads through the pulley 16, which is fixed to the overhead support 18. The rope assembly 11 is shown with an individual climber securely fitted into a chest harness 26 and a waist harness 20. The chest harness 26 and waist harness 20 are connected, as discussed above, to provide additional safety, during climbing. Preferably, a helmet is worn to protect against any head injury and a gymnastic pad is placed directly under the overhead support 18 and the climber as an additional safety precaution. More preferably, the gymnastic pad should be at least eight inches in thickness.

It is also desirable that a fully trained instructor or instructors be present to fit the chest harness 26 and waist harness 20, manage both ends of the rope 10 and facilitate the rappel. There should also be sufficient emergency procedures in place to permit a climber to safely descend the rope 10, if a climber cannot use the rope 10 at height. For example, if a climber "freezes" during climbing, an additional rope assembly 11 may be set up as described above, to allow a trainer to ascend the rope 10 and immediately help the climber to safety.

The length of rope 10 on one side of the pulley 16 is the "ascent" side and the length of the rope 10 on the other side of the pulley 16 is the "descent" side. When a climber ascends the rope 10, it is preferable that the ascent instructor/coach 13 manage the rope 10 by pulling its length through a lower ascension device, such as for example the ascender 28. Once the climber is secure on the rope 10, and the tension created by the climber's body weight has pulled on the belay device 22, the stopper knot 24 is removed by pulling on the descent side of rope 10. Either the ascent coach 13 or the climber may take out the stopper knot 24. Once this is done, usually at a height when the climber's feet are between 3 and 6 feet off the ground, it is recommended but not required that the descent coach 17 ask the climber to demonstrate how he/she will manage the rope 10 descent, by practicing the action of the belay device 22.

If the climber has sufficient strength and chooses to manage the climb without assistance, the rope assembly 11 allows for the climber to place one hand on the handle-bar mounted grip 30 and pull while the other hand takes up the loose slack of the rope 10. If the climber engages in this action, then the ascent coach 13 may continue to manage the rope 10 for alignment as well as to determine when and if the climber needs any additional pull action from the ascent coach 13. Whether the ascent coach 13 assists in pulling or whether he/she monitors and guides the rope 10, it is preferable, though not mandatory that the ascent coach 13 work without gloves so that the ascent coach 13 can feel the true tension of the rope 10. This tension will vary, based on the strength and the control the subject climber provides while pulling up on the handle-bar mounted grip 30. The ascent coach 13 can also guide the climber's direction and provide motivation, once appropriately trained and practiced in the application of the rope assembly 11. The ascent coach 13 creates tension on the climber by pulling on the climbing end of the rope 10, carefully angling the tension through the climbers' ascension device, such as for example the ascender 28. The climbers' pulls create slack in the rope 10 and the ascent coach 13 tightens the rope 10 in response.

When the ascent coach and climber have determined that the climb in height is complete, control shifts from the ascent side of the rope 10 to the descent side of the rope 10. At this point, the descent coach/instructor 17 takes control of coaching and assisting the climber's movement down. The rope 10 is connected to the belay device 22, which enables the climber to descend the rope 10. It should be noted that any type of belay device may be used, including but not limited to an auto-belay device. The descent side of the rope 10 is fed into the belay device 22, taking care to follow the symbolic direction on the belay device itself, which directs one end of the rope 10 to go up or toward the climber, and the other end of the rope 10 to go down or toward the hand of the descent coach 17. In this system of operation, one end of the rope 10 is pulled toward the descent coach 17 and the other end of the rope 10 is pulled directly toward the fixed pulley 16 overhead.

The descent coach 17 observes the length of rope 10 below the climber to ensure that there is sufficient rope 10 to feed through the climber's belay device 22. Using simplified standard climbing language, the descent coach 17 communicates with the climber through necessary instructions to enable safe descent, in most cases into a wheel chair or onto a sitting position on the safety gymnastics pad on the floor. An important role for the descent coach 17 is to manage the length of rope 10 between the belay device 22 and the end of the rope 10. Though obvious when the problem occurs, because the descent can run out of rope 10 while the climber is still in the descent, the task of coaching demands that the descent rope 10 is measured to at least twice the height of the climb plus several more feet. Should this length of rope 10 be overlooked, the descent coach 17 must stop the climber in the descent, knot off the rope 10 that is left, and get up to the climber by another means and then safely manage the descent to the gymnastics pad through the descent side of the rope 10.

Generally, the length of rope 10 for the successful operation of the rope assembly 11 must be at least four times the height of the climb. This initial calculation ensures that the descent coach 17 always has a manageable length of rope 10 through which the climber can descend. Once the total length of rope 10 is accounted for and in operation, the ascent coach 13 and descent coach 17 must each work together to ensure that at all times, the remaining length of rope 10 on the descent side is long enough to pass through the climber's belay device 22 so as to enable safe descent. For example, for a 165 foot rope, if a climber reaches 20 feet in height, they will use 40 feet of rope, if a climber reaches 25 feet of height, they will use 50 feet of rope, and so on. Knowing the beginning length of rope (usually 165 feet) combined with observing the length of rope 10 available on the descent side, the ascent coach 13 and descent coach 17 are able to determine how frequently to run the rope 10 through the pulley 16 and re-set the conditions for safe climbing.

Once the climber is ready to descend, the descent coach 17 directs the climber to push the handlebar mounted grip 30 up above the climbers' head, and let go of the handlebar mounted grip 30 with both hands. The climber will be locked into the height of the rope 10 by application of the chest harness 26 to the rope 10, by the belay device 22. The descent coach 17 then asks the climber to relax in the seat and display both hands, giving the climber the confidence that he/she is safely locked into height on the rope 10.

At the point when the climber's hands are free, the coach reminds the climber to look over to the their side to look at the belay device 22, and asks the climber to take their right thumb and/or index finger and place it on the lever handle of the belay device 22. If the rope 10 or any part of the clothing or the chest harness 26 impedes the vision of the climber, the coach should help the climber find the lever handle of the belay device 22. Once the climber has the handle of the belay device 22, the coach asks the climber to flip it over to the other side, slowly. The climber is then able to control the speed of descent by the degree to which he or she releases the handle of the belay device 22. The descent coach 17 watches and controls the descent side of the rope 10 throughout this process, constantly communicating with the climber. The most important job of the descent coach 17 is to estimate the rope 10 length so that the descending climber has sufficient rope 10 to pass through the belay device 22 to complete a safe, controlled descent to the gymnastics pad. If there is occasion where the length of rope 10 is not sufficient, the descent coach 17 instructs the climber to stop, maintains a safe tension on the descent side of the rope 10, and then takes steps to get the climber down safely into a chair or onto a mat.

Changes may be made in the construction and the operation of the various components, elements and assemblies described herein or in the steps or the sequence of steps of the methods described herein without departing from the spirit and scope of the invention. While presently preferred embodiments of the invention have been described for purposes of this disclosure, it will be understood that changes may be made which will readily suggest themselves to those skilled in the art and which are accomplished within the spirit and scope of the invention disclosed and as defined in the appended claims.

What is claimed is:

1. An apparatus for climbing, comprising:

a pulley connected to a support structure positioned a distance above a ground surface;

a rope looped over the pulley so as to define an ascent portion and a descent portion;

a first ascender device connected to the ascent portion of the rope in a way that the first ascender device is slideable in an upward direction along the ascent portion of the rope;

a second ascender device connected to the ascent portion of the rope above the first ascender device in a way that the second ascender device is slideable in an upward direction along the ascent portion of the rope, the second ascender device having a body with a first side, a second side, and a handle bar with a first hand gripping portion extending laterally from the first side and a second hand gripping portion extending laterally from the second side in axial alignment with the first hand gripping portion;

a belay device connected to the descent portion of the rope;

a chest harness connected to the first ascender device, the chest harness configured to be secured about the chest of a climber;

a waist harness connected to the belay device, the waist harness configured to be secured about the waist of the climber; and wherein the body of the second ascender device has a hole extending through the body from the first side to the second side, and wherein the handle bar extends through the hole so as to define the first hand gripping portion and the second hand gripping portion.

2. The apparatus of claim 1, wherein the first hand gripping portion and the second hand gripping portion of the handle bar extend from the body of the second ascender device an equal distance.

3. The apparatus of claim 1, wherein the hole is circularly shaped, and wherein the handle bar is cylindrically shaped.

* * * * *